US011527257B2

(12) United States Patent
Lou

(10) Patent No.: US 11,527,257 B2
(45) Date of Patent: Dec. 13, 2022

(54) METHOD FOR DETECTING AUDIO SIGNAL BEAT POINTS OF BASS DRUM, AND TERMINAL

(71) Applicant: GUANGZHOU BAIGUOYUAN INFORMATION TECHNOLOGY CO., LTD., Guangzhou (CN)

(72) Inventor: Fan Lou, Guangzhou (CN)

(73) Assignee: BIGO TECHNOLOGY PTE. LTD., Mapletree Business (SG)

( * ) Notice: Subject to any disclaimer, the term of this patent is extended or adjusted under 35 U.S.C. 154(b) by 254 days.

(21) Appl. No.: 16/957,573

(22) PCT Filed: Dec. 4, 2018

(86) PCT No.: PCT/CN2018/119111
§ 371 (c)(1),
(2) Date: Jun. 24, 2020

(87) PCT Pub. No.: WO2019/128639
PCT Pub. Date: Jul. 4, 2019

(65) Prior Publication Data

US 2020/0327898 A1 Oct. 15, 2020

(30) Foreign Application Priority Data

Dec. 26, 2017 (CN) ..... 201711434371.0

(51) Int. Cl.
*G10L 25/51* (2013.01)

(52) U.S. Cl.
CPC ..... *G10L 25/51* (2013.01); *G10H 2210/076* (2013.01)

(58) Field of Classification Search
CPC combination set(s) only.
See application file for complete search history.

(56) References Cited

U.S. PATENT DOCUMENTS 4,809,195 A * 2/1989 Bechet ..... G06T 9/001 345/441
9,286,876 B1 * 3/2016 Dabby ..... B42D 15/022
(Continued)

FOREIGN PATENT DOCUMENTS

CN 101123086 A 2/2008
CN 101216344 A 7/2008
(Continued)

OTHER PUBLICATIONS

International search report of PCT application No. PCT/CN2018/119111 dated Mar. 15, 2019.
(Continued)

*Primary Examiner* — Duc Nguyen
*Assistant Examiner* — Assad Mohammed
(74) *Attorney, Agent, or Firm* — Dilworth & Barrese, LLP

(57) ABSTRACT

A method for detecting audio signal beat points of a bass drum, and a terminal. The method comprises: acquiring several intrinsic mode functions based on an inputted audio signal to be detected; calculating instantaneous signals, wherein the instantaneous signals includes instantaneous strength signals and instantaneous frequency signals corresponding to the several intrinsic mode functions; acquiring characteristic signals of the bass drum based on the instantaneous strength signals and the instantaneous frequency signals corresponding to the several intrinsic mode functions; performing peak detection on the characteristic signals to acquire a plurality of peak points; and acquiring the beat points of the bass drum based on the plurality of peak points.

16 Claims, 3 Drawing Sheets

(56) References Cited

U.S. PATENT DOCUMENTS

| | | | | |
|---|---|---|---|---|
| 2002/0172372 | A1* | 11/2002 | Tagawa | G06F 16/683 |
| 2008/0034948 | A1 | 2/2008 | Sumita | |
| 2009/0322854 | A1* | 12/2009 | Ellner | H04N 7/147<br>348/E7.083 |
| 2011/0255700 | A1* | 10/2011 | Maxwell | H04R 5/027<br>381/58 |
| 2016/0334500 | A1* | 11/2016 | Damaria | H04R 3/005 |
| 2018/0181730 | A1* | 6/2018 | Lyske | G06F 21/10 |

FOREIGN PATENT DOCUMENTS

| | | | |
|---|---|---|---|
| CN | 101399035 | A | 4/2009 |
| CN | 102129858 | A | 7/2011 |
| CN | 103077706 | A | 5/2013 |
| CN | 103854644 | A | 6/2014 |
| CN | 104299621 | A | 1/2015 |
| CN | 108335687 | A | 7/2018 |
| JP | 2015040970 | A | 3/2015 |

OTHER PUBLICATIONS

First office action of Chinese application No. 201711434371.0 dated Apr. 20, 2020.

Notification to grant patent right for invention of Chinese application No. 201711434371.0 dated Jul. 10, 2020.

Qiqing Yin, et al; Drum Sounds Recognition Based on Rhythm, Soft Ware Guide, vol. 12, No. 6, Jun. 30, 2013 (Jun. 30, 2013), pp. 140-143.

N. E. Huang et al., "The empirical mode decomposition and the Hilbert spectrum for nonlinear and non-stationary time series analysis", Proc. Royal Soc. London A, vol. 454, pp. 903-995, 1998.

* cited by examiner

METHOD FOR DETECTING AUDIO SIGNAL BEAT POINTS OF BASS DRUM, AND TERMINAL

CROSS-REFERENCE TO RELATED APPLICATION

This application is a National Stage of International Application No. PCT/CN2018/119111 filed on Dec. 4, 2018, the entire content of which is incorporated herein by reference.

TECHNICAL FIELD

The present disclosure relates to the technical field of multimedia information, and more particularly, relates to a method for detecting audio signal beat points of a bass drum, and a terminal.

BACKGROUND

The bass drum is a bass drum pedaled in a drum set. The beat points of the bass drum tend to have a strong rhythm in music played with the bass drum. Therefore, it is of great significance to detect the beat points of the bass drum and apply them to various scenes required by users.

SUMMARY

The present disclosure provides a method for detecting audio signal beat points of a bass drum, and a terminal.

According to a first aspect, embodiments of the present disclosure provide a method for detecting audio signal beat points of a bass drum. The method includes:

acquiring a plurality of intrinsic mode functions based on an input audio signal to be detected;

calculating instantaneous signals corresponding to the plurality of intrinsic mode functions, wherein the instantaneous signals comprises instantaneous strength signals and instantaneous frequency signals;

acquiring characteristic signals of the bass drum based on the instantaneous strength signals and the instantaneous frequency signals corresponding to the plurality of intrinsic mode functions;

performing peak detection on the characteristic signals to acquire a plurality of peak points; and acquiring the beat points of the bass drum based on the plurality of peak points.

According to a second aspect, embodiments of the present disclosure further provides a computer-readable storage medium storing at least one computer program, wherein the at least one computer program, when being executed by a processor, enables the processor to perform the method for detecting the audio signal beat points of the bass drum as mentioned above.

According to a third aspect, embodiments of the present disclosure further provides a terminal. The terminal includes:

at least one processors; and a memory for storing at least one programs, wherein when the at least one programs are executed by the at least one processors, the at least one processors are enabled perform the method for detecting the audio signal beat points of the bass drum as mentioned above.

Additional aspects and advantages of the present disclosure will be described in the following description, will become apparent from the following description or will be understood by practicing the present disclosure.

BRIEF DESCRIPTION OF THE DRAWINGS

The above and/or additional aspects and advantages of the present disclosure will become apparent and easily understood from the following description of the embodiments with reference to the accompanying drawings, in which.

DETAILED DESCRIPTION

Figure 1:
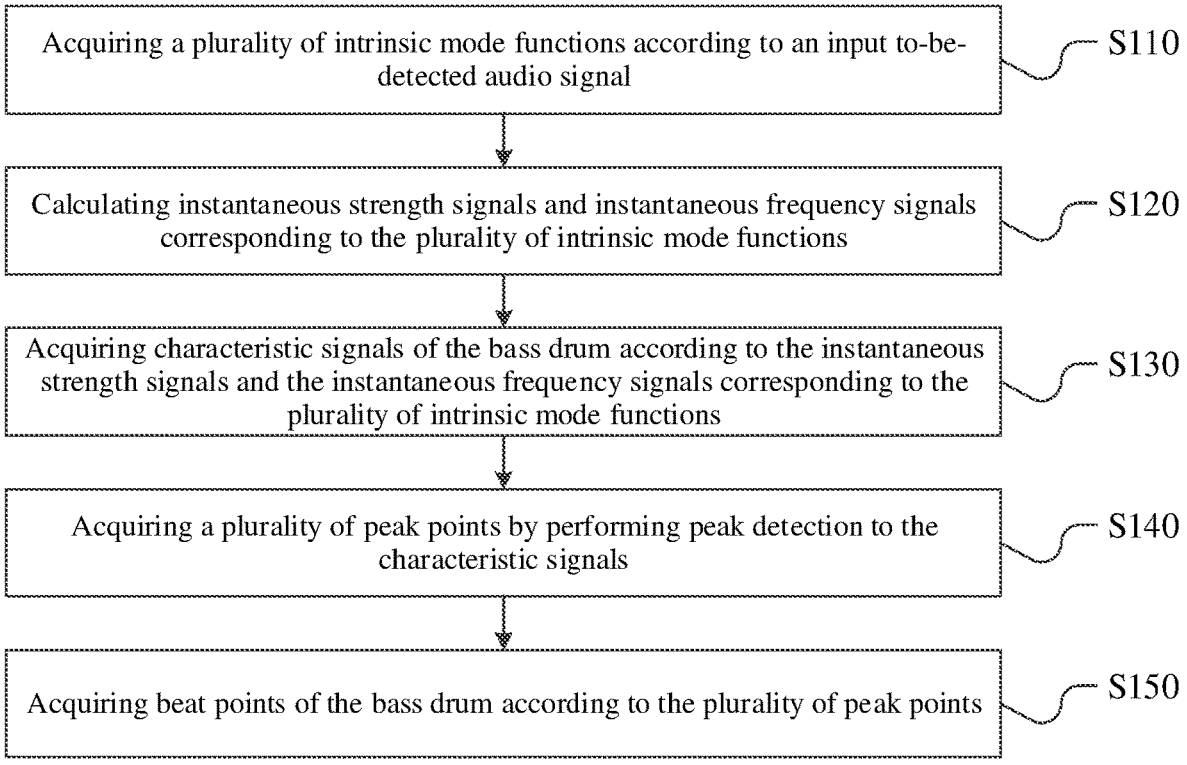
FIG. 1 is a schematic flowchart of a method for detecting audio signal beat points of a bass drum according to an embodiment of the present disclosure.

A description will be made in detail to the embodiments of the present disclosure, examples of which are illustrated in the accompanying drawings. The reference numbers which are the same or similar throughout the accompanying drawings represent the same or similar elements or elements with the same or similar functions. The following embodiments described with reference to the accompanying drawings are illustrative and only used to explain the present disclosure, but may not to be interpreted as the restrictions of the present disclosure.

It can be understood by those skilled in the art that the singular forms "a", "an", "the", and "said" may also encompass plural forms, unless otherwise stated. It should be further understood that the term "include/comprise" used in the description of the present disclosure means there exists a feature, an integer, a step, an operation, an element and/or a component, but could not preclude existing or adding of at least one other features, integers, steps, operations, elements, components and/or groups thereof. The phrase "and/or" used herein includes all or any one unit and all combinations of at least one related listed items.

Those skilled in the art will appreciate that all terms (including technical and scientific terms) as used herein have the same meanings as commonly understood by those of ordinary skill in the art of the present disclosure, unless otherwise defined. It also should be understood that terms such as those defined in the general dictionary should be understood to have the meanings consistent with the meanings in the context of the prior art, and will not be interpreted in an idealized or overly formal meaning unless specifically defined as herein.

Generally, music is played with various musical instruments, such that it is difficult to directly detect the beat points of the bass drum. In the conventional art, the beat points of the bass drum in each piece of music generally need to be detected manually, and thus efficiency is low.

Those skilled in the art may understand that the term "terminal" used herein includes a device of a wireless signal receiver, only having a device of a wireless signal receiver without transmitting ability, and further includes device of receiving and transmitting hardware, having a device of receiving and transmitting hardware capable of performing two-way communication in a two-way communication link. The device may include: cellular or other communication devices, having cellular or other communication devices with a single-line display or a multi-line display or without a multi-line display; personal communications service (PCS) may combine voice, data processing, fax and/or data communication abilities; a personal digital assistant (PDA) may include a radio frequency receiver, pager, Internet/intranet access, a web browser, a notebook, a calendar, and/or a global positioning system (GPS) receiver; and a conventional laptop and/or palmtop computer or other devices may have and/or include a conventional laptop and/or palmtop computer or other device of a radio frequency receiver. "Terminal" used herein may be portable, transportable, installed in a vehicle (aviation, sea transportation and/or land), or adapted to and/or configured to operate locally, and/or in a distributed form, operate in any other positions in the earth and/or a space. The term "terminal" used herein may further be a communication terminal, an Internet surfing terminal, and a music/video playing terminal, for example, may be a PDA, a mobile Internet device (MID) and/or a mobile phone with a music/video playing function, and may further be a device such as a smart television, a set top box, or the like.

It is necessary to give the following introductory explanation to the technical concept of the present disclosure.

In a method for detecting audio signal beat points of a bass drum and a terminal according to an embodiment of the present disclosure, characteristic information of the bass drum is extracted from an audio signal by aiming at the acoustic characteristic of the bass drum, and then peak points are calculated by the characteristic information of the bass drum, wherein the peak points are accurate time points when bass drum knocking events occur in the music, such that beat point information is acquired based on the peak point to be applied to various scenes required by users, for example, adding audio and video effects, or the like.

The embodiments of the present disclosure will be introduced below in detail with reference to the accompanying drawings.

As shown in FIG. 1, which is a flow schematic diagram of a method for detecting audio signal beat points of a bass drum according to an embodiment, the detection method includes the following steps.

In step S110, a plurality of intrinsic mode functions are acquired based on an input audio signal to be detected.

Due to detection on the beat points of the bass drum, the audio signal to be detected is generally an audio signal including bass drum performance. Users may input the audio signal to be detected by selecting music in a music library or uploading music by themselves.

In order to satisfy the diversified requirements of the users, for example, only some audio signals need to be detected while other audio signals do not need to be detected, optionally, whether beat point detection is required for the input music is identified firstly; for the music requiring beat point detection, the beat points of the bass drum are detected by the method according to the embodiment of the present disclosure, otherwise, it is performed according to the conventional operation method. In specific implementation, a pop-up window may be set to display whether to detect the beat points of the bass drum for the input music, and then whether to perform the method according to the embodiment of the present disclosure is identified according to corresponding function options triggered by the users.

An instantaneous frequency value defined by Hilbert transformation has no definite physical meaning in some cases. Research shows that only signals meeting specific conditions have an instantaneous frequency with physical meaning and are called intrinsic mode functions (IMF). Based on this, a set of method for acquiring the intrinsic mode functions through signal adaptive decomposition is established, namely empirical mode decomposition (EMD). The instantaneous frequency is for any time series, a complex analytic signal may be uniquely acquired by Hilbert transformation, and a change rate of a phase of the complex analytic signal with time is defined as the instantaneous frequency.

In step S120, instantaneous signals corresponding to the plurality of intrinsic mode functions are calculated. The instantaneous signals comprises instantaneous strength signals and instantaneous frequency signals.

That is, for the above plurality of intrinsic mode functions, the instantaneous signals corresponding to the plurality of intrinsic mode functions are calculated respectively, and the instantaneous signals comprises instantaneous strength signals and instantaneous frequency signals, The instantaneous strength signals and the instantaneous frequency signals corresponding to all the intrinsic mode functions may be acquired by calculating the instantaneous strength signal and the instantaneous frequency signal corresponding to each of the intrinsic mode functions.

In step S130, characteristic signals of the bass drum are acquired based on the instantaneous signals (that is, the instantaneous strength signals and the instantaneous frequency signals) corresponding to the plurality of intrinsic mode functions.

The characteristic signals are used for representing the unique characteristics of the bass drum, different from sound of other musical instruments or characters. The characteristic signals of the bass drum may be calculated after the instantaneous strength signals and the instantaneous frequency signals corresponding to all the intrinsic mode functions are acquired.

In step S140, a plurality of peak points are acquired by performing peak detection on the characteristic signals.

The peak detection is used for detecting the peak points of the characteristic signals. Each of the peak points represents a time point when the bass drum is knocked, that is, a time point when the user knocks the bass drum.

In step S150, beat points of the bass drum are acquired based on the plurality of peak points.

The peak points, namely the specific time points when all the bass drum are knocked in the music, are acquired, and then music rhythm information is further analyzed by the acquired time points to acquire the final beat point information.

According to the above embodiment, the characteristic signals of the bass drum are extracted by the intrinsic mode functions; the peak points are acquired by performing peak detection to the characteristic signals, wherein the peak points are time points when the bass drum is knocked in the music; and the beat points can be acquired based on the time points when the bass drum is knocked; therefore, the beat points of the bass drum is automatically acquired and the efficiency is high.

After inputting the audio signal to be detected and before acquiring the plurality of intrinsic mode functions based on the audio signal to be detected, optionally, the method further includes a step of preprocessing the audio signal to be detected. There are many ways of preprocessing. A embodiment will be introduced below. It should be understood that the present disclosure is not limited to the following preprocessing method, and the users also may adopt other preprocessing operation according to requirements.

Preprocessing the signal to be detected includes the following steps.

In step S1101, the audio signal to be detected is resampled at a set sampling rate. Resampling can reduce the input semaphone, thereby greatly reducing time consumed in the calculation of the method according to the present disclosure, and enabling the method according to the present disclosure to give processing results within an acceptable time range for subsequent use. Through repeated tests and analysis, a good effect is achieved when a sampling rate is 2 kilohertz (kHz).

In step S1102, low-pass filtering is performed to the resampled audio signal to be detected. Through repeated test and analysis, a filter used herein is an 8-order Butterworth low-pass filter (the cut-off frequency is 150 Hz), which can effectively reduce interference elements such as different musical instruments, human voice singing, or the like included in the audio signal to be detected and can maximally retain the elements of the bass drum, thus enabling subsequent characteristic extraction to be more accurate.

Figure 2:
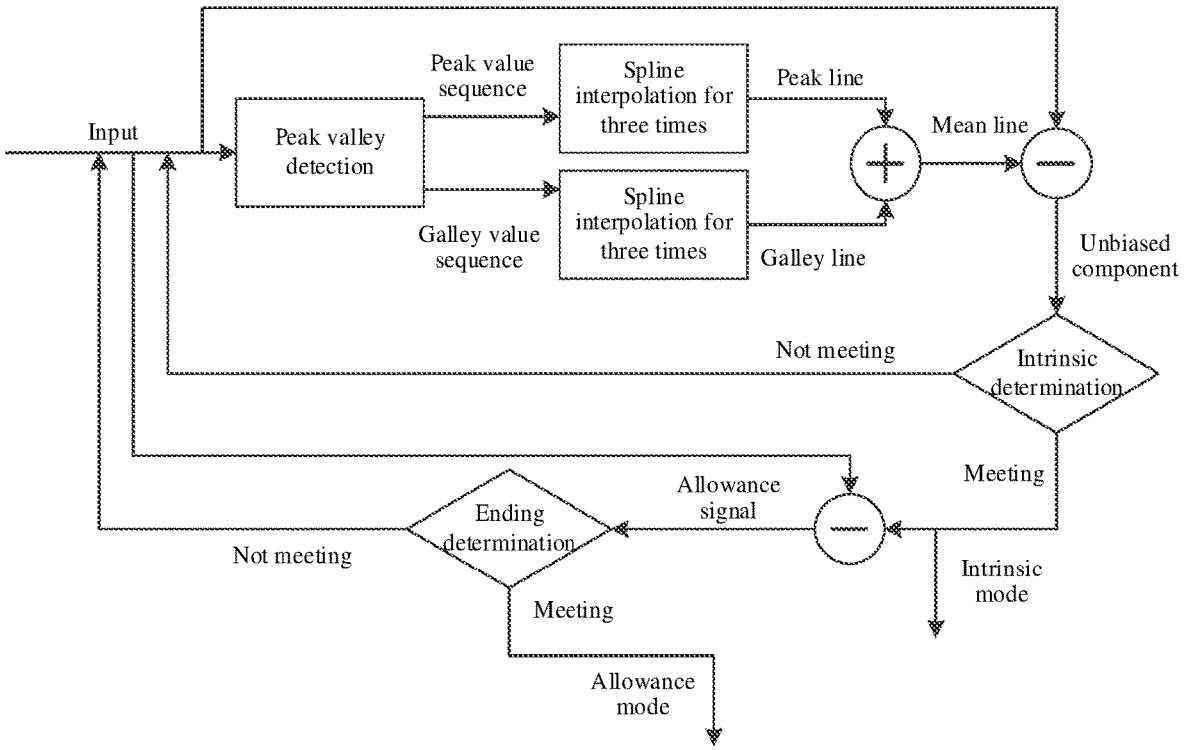
FIG. 2 is a schematic flowchart of acquiring a plurality of intrinsic mode functions by empirical mode decomposition according to an embodiment of the present disclosure.

Empirical mode decomposition is an important step in Hilbert transformation, as shown in FIG. 2 which is a schematic flowchart of acquiring a plurality of intrinsic mode functions by empirical mode decomposition, includes the following steps.

In step S1105, a peak sequence and a valley sequence are respectively acquired by performing peak valley detection on the input audio signal to be detected.

In step S1106, an upper envelope line (peak line) and a lower envelope line (valley line) of the audio signal to be detected are acquired by performing spline interpolation on the peak sequence and the valley sequence respectively for three times.

In step S1107, a mean line is acquired by summing the upper envelope line and the lower envelope line and then averaging the sum.

In step S1108, an unbiased high-frequency component of the signal is acquired by subtracting the mean line from the audio signal to be detected.

In step S1109, whether the acquired unbiased high-frequency component satisfies an intrinsic condition is identified, wherein in the case where the acquired unbiased high-frequency component satisfies the intrinsic condition, the signal is recorded as an intrinsic mode; and in the case where the acquired unbiased high-frequency component does not satisfy the intrinsic condition, the acquired unbiased high-frequency component is set as an input signal to perform steps S1105 to S1108 again to acquire a new unbiased high-frequency component.

Optionally, the criteria for identifying the intrinsic condition are: for the unbiased high-frequency components, the difference between the number of extreme points and the number of zero crossing points is not more than 1, or the standard deviation between the unbiased high-frequency components performing iteration twice is less than a set value, or the number of the consecutive iteration times exceeds a set number of times. The standard deviation herein is defined as:

$$S_d = \sum_{t=0}^{T} \frac{\|h_{k-1}(t) - h_k(t)\|^2}{h_k^2(t)}$$

where $h_k(t)$ is the unbiased high-frequency component acquired in the $k^{th}$ iteration.

In step S110, the acquired intrinsic mode signal is subtracted from the input audio signal to be detected to acquire an allowance signal; whether the allowance signal satisfies end determination is identified; if the allowance signal satisfies end determination, an allowance mode is acquired; otherwise, the allowance signal is set as an audio signal to be detected and steps S1105 to S1109 are performed again to acquire the next intrinsic mode signal.

Optionally, the criteria for identifying the end determination are: absolute values of all the numerical values of the allowance signal are less than a certain threshold, or the number of peak sequences or valley sequences acquired by performing peak valley detection on the allowance signal is less than a set threshold.

Finally, the input audio signal to be detected is decomposed into a plurality of intrinsic mode signals and an allowance mode signal, which are called intrinsic mode functions of the input audio signal to be detected, by the empirical mode decomposition.

The empirical mode decomposition has two inherent problems, one is end effect and the other one is modal aliasing. The modal aliasing is: when two groups of harmonious wave with equal strength and small frequency difference are mutually superimposed, the two harmonious wave components cannot be completely separated by the empirical mode decomposition, and the decomposed signals have the phenomenon of modal aliasing. The instantaneous frequency of the intrinsic mode functions with aliasing does not have accurate physical meaning any longer, which will result in deviation in the finally extracted characteristics of the bass drum.

Due to the aforementioned low-pass filter and the above characteristic smoothing effect, the modal aliasing can be effectively inhibited. Optionally, error caused by the end effect is inhibited by periodic extension in the present disclosure, and the process of the periodic extension is as follows.

In step S1103, a section of signal with a specific length is selected at an endpoint, and a signal most proximal to the signal is searched within a certain range proximal to the endpoints.

In step S1104, the original endpoints are subjected to signal extension by a previous signal of the found signal.

In step S1105, a more accurate peak sequence and valley sequence are acquired by performing peak valley detection on the extended signal.

The error caused by the end effect on the empirical mode decomposition can be effectively reduced by the above solutions.

In one embodiment, calculating instantaneous strength signals and instantaneous frequency signals corresponding to the plurality of intrinsic mode functions includes the following steps.

In step S1201, corresponding complex analytic signals $H_i$ are acquired by performing Hilbert transformation to all the intrinsic mode functions $Imf_i$ acquired by the aforementioned calculation.

In step S1202, for each complex analytic signal $H_i$, an instantaneous strength signal $A_i=\sqrt{R_i^2+I_i^2}$ and an instantaneous phase signal $\Phi_i=\tan^{-1}(I_i/R_i)$ are calculated, wherein $R_i$ and $I_i$ are respectively a real part and an imaginary part of $H_i$.

In step S1203, for each complex analytic signal $H_i$, an instantaneous frequency signal $\omega_1=(\Phi_i-\Phi_{i-1})/\Delta t$ is calculated.

Since the value of $\Phi_i$ is subjected to modulus operation of $[0,2\pi]$, it is necessary to perform certain adjustment to $\omega_i$ to eliminate mutation caused by modulus operation. For example, when is less than a certain negative value, $\omega_i$ is added to a positive deviation; and when $\omega_i$ is greater than a certain value, $\omega_i$ is added to a negative deviation.

In one embodiment, acquiring characteristic signals of the bass drum based on the instantaneous strength signals and the instantaneous frequency signals corresponding to the plurality of intrinsic mode functions includes: multiplying the squared instantaneous strength signal of a target function by the corresponding instantaneous frequency signal of the target function to acquire an equivalent instantaneous frequency of the target function, wherein the target function is any one of the plurality of the intrinsic mode functions; and summing the equivalent instantaneous frequencies of the plurality of intrinsic mode functions to acquire the characteristic signals of the bass drum. That is, the squared instantaneous strength signal of a target function is multiplied by the corresponding instantaneous frequency signal of the target function to acquire an equivalent instantaneous frequency of the target function; the target function is any one of the plurality of the intrinsic mode functions; and then, the equivalent instantaneous frequencies of the plurality of the intrinsic mode functions are summed to acquire the characteristic signals of the bass drum.

In the above embodiment, for each of the intrinsic mode functions, $A_i$ and $\omega_i$ are calculated respectively, and the characteristic signal $\zeta=\Sigma A_i^2\omega_i$ is finally calculated. The characteristic signal is calculated by the method, such that the characteristic of the bass drum signal can be highlighted maximally.

Since the characteristic signals calculated by the aforementioned method present obvious peak characteristics at a position where the bass drum is knocked, the accurate time point when the bass drum is knocked can be acquired by performing peak detection to the characteristic signals. In one embodiment, performing the peak detection on the characteristic signal to acquire the plurality of peak points includes: performing the peak detection on the characteristic signal to acquire maximum points; and selecting a maximum point that satisfies a preset condition from the maximum points and identifying the selected maximum point as the peak point, wherein the preset condition includes: any one point of the characteristic signals between two consecutive maximum points is not the maximum point, and a minimum value of the characteristic signals between the two consecutive maximum points is far less than the two consecutive maximum points.

The maximum point refers to the abscissa of the maximum in a certain sub-interval of function image. The maximum point and the minimum point are collectively called as the extreme point.

The embodiment of peak detection implements conditional peak detection, wherein the conditional peak detection means that when a certain maximum point of the characteristic signal satisfies the preset condition, the maximum point is identified as the peak point. Far less than is defined as that a ratio of the minimum to the two consecutive maximum points is less than a set ratio threshold, or a difference value between the minimum value and the two consecutive maximum points is greater than a set difference threshold.

The peak points need to be screened for one time to further improve the accuracy of the detection result; therefore, in one embodiment, after identifying the selected maximum point as the peak point, the method further includes: calculating a full width at half maximum of a signal peak formed by each peak point and adjacent points of each peak point after Gaussian fitting; and retaining a corresponding peak point, if the full width at half maximum is less than a preset threshold, otherwise, eliminating the corresponding peak point.

In the above embodiment, the adjacent points of a peak point refer to signal points proximal to the peak point, that is, a difference value between each of the signal points and the peak point is less than a preset threshold. For each peak point, the peak point and adjacent signal points of the peak point form a signal peak. The full width at half maximum is a distance between front and back points of which the signal values are equal to half of the peak value in one peak of the signal, and is generally used for representing a duration of the signal peak. For any one peak point, the full width half maximum after a signal peak formed by the peak point and adjacent points of the peak point fitted by Gaussian should be less than a certain threshold, and the peak point is eliminated in the case where the full width half maximum is not less than the certain threshold.

According to the above embodiment, a set of unique peak detection determination condition (namely a preset condition) is designed by completely combining the character of the characteristic signal of the bass drum acquired by empirical mode decomposition and the acoustic characteristic of the bass drum, thus maximally ensuring the detection accuracy of the bass drum and reducing the probability of misjudgment.

Although the aforementioned low-pass filter effectively reduces the influence by the modal aliasing of the empirical mode decomposition, but a small amount of interference is still remained. For example, the characteristic signal acquired by calculation often slightly shakes up and down, which does not generate large interference on the result for places with sufficient strength of the bass drum, but influences the detection result for bass drum points with insufficient strength and interference points such as places with strong bass to reduce the final accuracy. In order to solve the problem, it is necessary to smooth the characteristic signal. Therefore, in one embodiment, after acquiring the characteristic signal of the bass drum and before performing the peak detection on the characteristic signal to acquire the plurality of peak points, the method further includes the following steps.

In step S131, all galley points of the characteristic signal are acquired.

The galley points are minimum points of the characteristic signal.

In step S132, a full width half maximum of a signal valley formed by each of the valley points and two peak points most proximal to the valley point are calculated.

For each of the valley points, the valley point and two peak points most proximal to the valley point form a signal valley. A full width half maximum of each of the signal valleys is calculated.

In step S133, a signal valley with the full width at half maximum less than a preset first threshold is acquired, and the acquired signal valley using the characteristic signals adjacent to the acquired signal valley by interpolation is eliminated.

In the embodiment of the present disclosure, the acquired signal valley using the characteristic signals adjacent to the acquired signal valley by interpolation is eliminated.

The characteristic signal adjacent to the signal valley refers to a characteristic signal with a distance from the signal valley less than a preset threshold. When the full width at half maximum of a certain signal valley is less than the preset threshold, the characteristic signal adjacent to the signal valley is used to eliminate the signal valley by interpolation. That is, the characteristic signal adjacent to the signal valley is interpolated, and the signal valley is replaced by a signal acquired through interpolation.

In step S134, the preset first threshold value is updated, and the step of acquiring the signal valley with the full width at half maximum less than the preset first threshold is returned until a smooth characteristic signal is acquired.

That is, according to the solutions shown in the present disclosure, in the step S134, the preset first threshold value is updated, and the step of acquiring the signal valley with the full width at half maximum less than the preset first threshold is returned until the smooth characteristic signal is acquired.

The above step is repeated for several times by different thresholds until a smooth characteristic signal is acquired. Subsequently, peak detection (namely conditional peak detection) may be performed by the smooth characteristic signal, thereby further improving the accuracy of the detection result.

It should be understood that the present disclosure is not limited to the above smoothing solution, and any smoothing operation with low-pass filter characteristics such as average filtering, Gaussian smoothing, or the like should be regarded as an equivalent process.

Due to the influence of smoothing, the peak point acquired through conditional peak detection may not accurately correspond to the peak point of the original characteristic signal, and it is necessary to perform certain time alignment. In one embodiment, after performing the peak detection on the characteristic signals to acquire a plurality of peak points by and before acquiring beat points of the bass drum according to the plurality of peak points, the method further includes: finding a maximum value within an adjacent area of a position indicated by each of the peak points in the characteristic signal, and taking the point with the found maximum value as an aligned peak point.

In the above embodiment, for each of the peak points, the adjacent area means that a distance between each point and the corresponding peak point is less than a preset threshold. For each of the peak points, the maximum value is found within a certain range adjacent to the position of the characteristic signal, and the maximum point is output as an aligned peak point.

For most of music with the bass drum, the peak points acquired by the above steps already have high accuracy; however, for a small part of music, especially for the music with strong low-frequency interference sources such as a Bass, a hand drum, a bass, or the like, the acquired peak points have some misjudgment points. In order to solve the problem, the acquired peak points are further screened and eliminated by secondary screening. Therefore, in one embodiment, after performing the peak detection on the characteristic signal to acquire the plurality of peak points and before acquiring the beat points of the bass drum based on the plurality of peak points, the method further includes the following steps.

The plurality of peak points are eliminated by a specified processing mode, the specified processing mode includes one of the following processing mode (that is, S141, S142, and S143).

In step S141, the number of the characteristic signals, of which values exceed a preset ratio of the values of the characteristic signals corresponding to the corresponding peak points, in the adjacent area is counted within the adjacent area of the position indicated by each of the peak points in the characteristic signals, and the corresponding peak points are eliminated in the case where the number exceeds a preset threshold.

In the step, the value of the characteristic signal is a value of $\zeta$. Taking the characteristic signal is presented by a coordinate system of an X axis and a Y axis as an example, X axis is used for representing positions (that is, time points), and Y axis is used for representing values of $\zeta$. The adjacent area means that a distance between each point and the corresponding peak point is less than a preset threshold. The preset ratio and the preset threshold may be set according to practical requirements. For each of the peak points, the number of the characteristic signals, of which the values exceed the preset ratio of the values of the characteristic signals corresponding to the peak points, adjacent to the peak point is calculated, and the peak point is eliminated when the number exceeds the preset threshold.

In step S142, in the case where an interval between the two consecutive peak points is less than a preset interval threshold, the peak points corresponding to the characteristic signals with small values in the two consecutive peak points are eliminated.

In the above step, the two consecutive peak points refer to two adjacent peak points. When an interval between the two consecutive peak points is less than a preset threshold, the peak points corresponding to the characteristic signals with smaller values are eliminated.

In step S143, in the case where the values of the characteristic signals corresponding to one peak point are less than the values of the characteristic signals corresponding to other peak points, a prominent degree of the peak point compared with the characteristic signals in the adjacent area is calculated, and the peak point is eliminated in the case where the prominent degree is less than a preset threshold value.

In the above step, optionally, a prominent degree is calculated when the value of the characteristic signal corresponding to a certain peak point is obviously less than the values of the characteristic signals corresponding to other peak points of the whole piece of music, wherein the obviously less than means that a difference value between the value of the characteristic signal of the peak point and the value of the characteristic signal corresponding to each of other peak points is greater than a set value, or a ratio of the value of the characteristic signal of the peak point to the value of the characteristic signal corresponding to each of other peak points is less than a set value. The peak point is eliminated when the prominent degree is less than a preset threshold, that is the peak point is eliminated when the peak point is not obviously prominent compared with the peripheral characteristic signals. Optionally, the prominent degree refers to a ratio (1.5 times of a mean value plus a variance) of the peak point to the characteristic signals on the left side and the right side of the peak point within a certain range.

The beat point information acquired by the present disclosure can be used for products to process music as required. For example, in one embodiment, after acquiring the beat points of the bass drum based on the plurality of peak points, the method further includes: adding preset audio and video effects at positions where the beat points of the bass drum are located. The final video effect can be unified with music rhythm and emotion by adding a series of audio and video effects to the beat point positions of the bass drum according to the present disclosure, thereby having a better overall presentation effect.

It should be understood that after acquiring the beat points of the bass drum, the present disclosure is not limited to adding the audio and video effects to the beat points, and users can also perform other operation according to the acquired beat points, for example, on music game, or the like.

Figure 3:
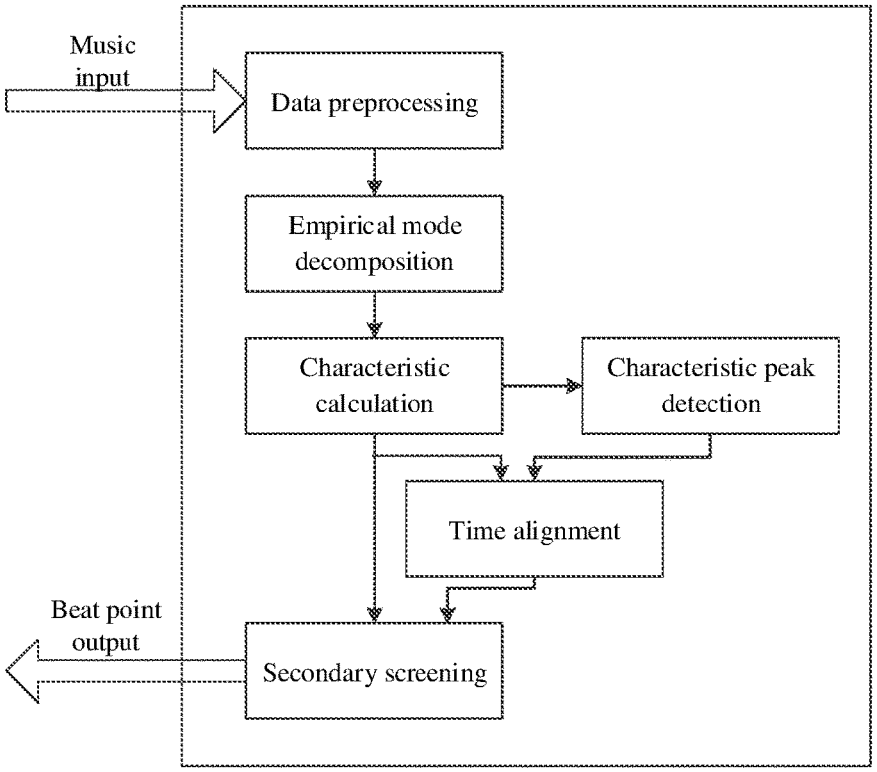
FIG. 3 is a schematic flowchart of a method for detecting audio signal beat points of a bass drum according to an embodiment of the present disclosure.

As shown in FIG. 3 which is a schematic flowchart of a method for detecting audio signal beat points of a bass drum according to an embodiment, the method may be implemented by digital signal processing program formed by a C++ code and may be operated on any computing hardware supporting a C++ operating environment. It should be understood that the present disclosure is not limited to be implemented by the C++ code, and the users also may adopt other programming languages.

In particular, the embodiment includes six parts, and relationships among all the parts and data processing flow are described below.

Part S1 is data preprocessing.

Original audio data is resampled at a sampling ratio of 2 kHz, and the resampled signal is subjected to low-pass filtering, wherein a filter used herein is an 8-order Butterworth low-pass filter with a cut-off frequency of 150 Hz.

Part S2 is empirical mode decomposition.

After the audio signal subjected to low-pass filtering is subjected to periodic extension, a plurality of intrinsic mode signals and an allowance mode signal, which are called intrinsic mode functions of the original audio signal, are acquired by performing empirical mode decomposition to the extended signal.

Part S3 is Characteristic calculation.

$A_i$ and $\omega_i$ are calculated respectively for each intrinsic mode function, and characteristic signals $\zeta=\Sigma A_i^2\omega_i$ are finally acquired.

Part S4 is characteristic peak detection.

The characteristic peak detection includes two steps: signal smoothing and conditional peak detection. A smooth characteristic signal is acquired by signal smoothing, and then the characteristic signal is subjected to conditional peak detection to acquire screened peak points.

Part S5 is time alignment.

For each of the peak points output by the characteristic peak detection, a maximum value is found within a certain range adjacent to a position on the characteristic signal by characteristic calculation, and the maximum point, serving as an aligned peak point, is output to a secondary screening step.

Part S6 is secondary screening.

The secondary screening includes three processes:

First, for each of the peak points output after the time alignment step, the number of points, exceeding a specific ratio of the values of the characteristic signals corresponding to the peak point, in the characteristic signals adjacent to the peak point is calculated, and the peak point is eliminated when the number exceeds a preset threshold.

Second, for each of the peak points output after the time alignment step, peak point corresponding to the characteristic signals with smaller value is eliminated when an interval between two consecutive peak points is less than a set threshold.

Third, for each of the peak points output after the time alignment step, a prominent degree of the peak point compared with the characteristic signals within a certain range adjacent to the peak point is analyzed when the value of the characteristic signal corresponding to a certain peak point is obviously less than the values of the characteristic signals corresponding to other peak points in the whole piece of music, and the peak point is eliminated when the peak point is not obviously prominent compared with the peripheral characteristic signals.

An accurate peak point can be acquired by the six parts. The peak point is an accurate time point when the bass drum is knocked, and music rhythm information analysis is further performed by the acquired bass drum knocking time point to acquire the final beat point information.

The embodiment of the present disclosure further provides a computer-readable storage medium storing at least one computer program. The at least one program, when being executed by a processor, enables the processor to perform the method for detecting the audio signal beat points of the bass drum as mentioned above. The storage medium includes, but not limited to any types of disks (including a soft disk, a hard disk, an optical disk, a CD-ROM and a magneto-optical disk), a read-only memory (ROM), an random access memory (RAM), an erasable programmable read-only memory (EPROM), an electrically erasable programmable read-only memory (EEPROM), a flash memory, a magnetic card or a light card. That is, the storage medium includes any mediums for storing or transmitting information by a device (such as a computer) in a readable form, and may be a read-only memory, a disk or an optical disk, or the like.

The embodiment of the present disclosure further provides a terminal. The terminal includes:

at least one processors; and a memory for storing at least one programs, wherein when the at least one programs are executed by the at least one processors, the at least one processors are enabled perform the method for detecting the audio signal beat points of the bass drum as mentioned above.

Figure 4:
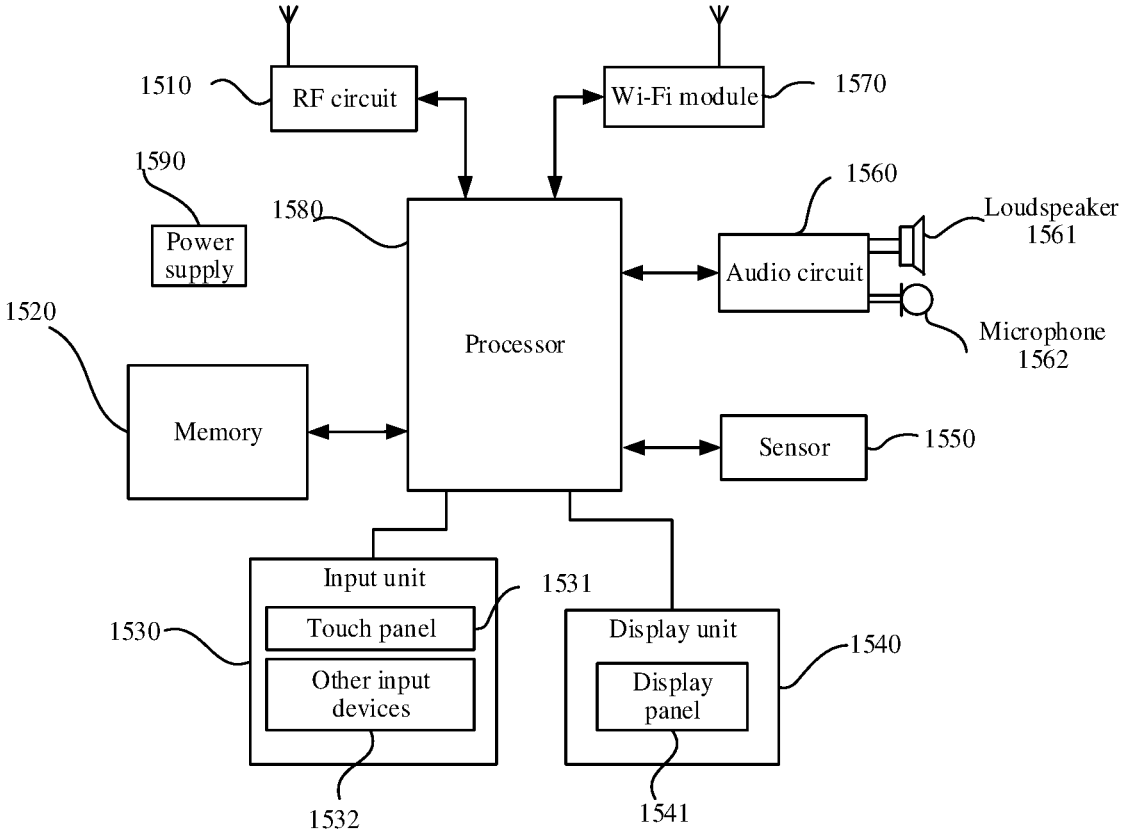
FIG. 4 is a schematic structural diagram of a terminal according to an embodiment of the present disclosure.

As shown in FIG. 4, in order to facilitate explanation, only a part related to the embodiment of the present disclosure is shown and specific technical details are not disclosed, referring to the method part according to the embodiments of the present disclosure. The terminal may include any terminal devices such as a mobile phone, a tablet computer, a personal digital assistant (PDA), point of sales (POS), a vehicle-mounted computer, or the like. The terminal being a mobile phone is taken as an example.

FIG. 4 shows a block diagram of a part of structure of a mobile phone related to a terminal according to an embodiment of the present disclosure. Referring to FIG. 4, the mobile phone includes parts such as a radio frequency (RF) circuit 1510, a memory 1520, an input unit 1530, a display unit 1540, a sensor 1550, an audio circuit 1560, a wireless fidelity (Wi-Fi) module 1570, a processor 1580, and a power source 1590, or the like. Those skilled in the art may understand that the mobile phone structure shown in FIG. 4 does not constitute a limitation to the mobile phone, may include more or fewer parts than those shown in the figure, or may combine some parts, or may arrange different parts.

Various parts of the mobile phone are introduced below in detail with reference to FIG. 4.

The RF circuit 1510 may be used for receiving and transmitting signals in an information receiving and transmitting or communication process, in particular, sending downlink information of a base station to a processor 1580 to process after receiving the downlink information of the base station; in addition, transmitting uplink data to the base station. Generally, the RF circuit 1510 includes, but not limited to an antenna, at least one amplifier, a transceiver, a coupler, a low noise amplifier (LNA), a duplexer, or the like. In addition, the RF circuit 1510 may further communicate with other devices by wireless communication and network.

The above wireless communication may use any one communication standard or protocol, including but not limited to global system of mobile communication (GSM), general packet radio service (GPRS), code division multiple access (CDMA), wideband code division multiple access (WCDMA), long terminal evolution (LTE), E-mail, short messaging service (SMS), or the like.

The memory 1520 may be used for storing software programs and modules, and the processor 1580 may operate the software programs and modules stored in the memory 1520, thereby performing various kinds of function applications and data processing of the mobile phone. The memory 1520 may mainly include a program storage region and a data storage region, wherein the program storage region may store an operating system, an application program required by at least one function (such as a beat point detection function, or the like); and the data storage region may store data (such as peak points, or the like) created according to use of the mobile phone. In addition, the memory 1520 may include a high speed random access memory, and may further include a nonvolatile memory such as at least one disk memory, a flash memory or other non-volatile solid state storage device.

The input unit 1530 may be used for receiving input digital or character information, and generating key signal input related to user setting and function control of the mobile phone. In particular, the input unit 1530 may include a touch panel 1531 and other input devices 1532. The touch panel 1531, also called a touch screen, may collect touch operation (for example, operation on the touch panel 1531 or proximal to the touch panel 1531 by fingers or any suitable objects or accessories such as a touch pen by the users) on or proximal to the touch panel by users, and drive a corresponding connection device according to a preset program. Optionally, the touch panel 1531 may include a touch detection device and a touch controller. The touch detection device detects a touch azimuth of the user, detects signals brought by touch operation, and transmits the signals to the touch controller; and the touch controller receives touch information from the touch detection device, converts the information into contact coordinates and transmits the coordinates to the processor 1580, and can receive a command transmitted by the processor 1580 and perform the command. In addition, the touch panel 1531 may be implemented by various types of resistance type, capacitance type, infrared rays, surface acoustic wave, or the like. In addition to the touch panel 1531, the input unit 1530 may further include other input devices 1532. In particular, other input devices 1532 may include but not limited to at least one of a physical keyboard, functional keys (such as a volume control key, a switch key, or the like), a trackball, a mouse, an operating rod, or the like.

The display unit 1540 may be used for displaying information input by the users or information provided for the users, and various menus of the mobile phone. The display unit 1540 may include a display panel 1541, optionally, the display panel 1541 may be configured by a liquid crystal display (LCD), an organic light-emitting diode (OLED), or the like. Further, the touch panel 1531 may cover the display panel 1541. The touch panel 1531 transmits touch operation to the processor 1580 to identify the types of touch events after detecting the touch operation on or proximal to the touch panel 1531, and then the processor 1580 provides corresponding vision output on the display panel 1541 according to the touch events. In FIG. 4, the touch panel 1531 and the display panel 1541 serve as two independent parts to realize the input and input functions of the mobile phone, but in some embodiments, the touch panel 1531 may be integrated with the display panel 1541 to realize the input and input functions of the mobile phone.

The mobile phone may further include at least one sensor 1550, for example a light sensor, a motion sensor, and other sensors. In particular, the light sensor may include an ambient light sensor and a proximity sensor. The ambient light sensor may adjust the luminance of the display panel 1541 according to the brightness of the ambient light; and the proximity sensor may turn off the display panel 1541 and/or backlight when the mobile phone is moved to the ear. As one of the motion sensors, an accelerometer sensor may detect a magnitude of accelerated speed in various directions (generally three axes), may detect a magnitude and a direction of gravity when stationary, and may be used for application that recognize phone gesture (such as horizontal and vertical screen switching, related games, and magnetometer posture calibration), vibration identification related functions (such as pedometer and knocked), or the like. The mobile phone may be configured for other sensors such as a gyroscope, a barometer, a humidometer, a thermometer, an infrared sensor, or the like, and is not repeatedly described.

The audio circuit 1560, the loudspeaker 1561, and the microphone 1562 may provide an audio interface between users and mobile phones. The audio signal 1560 may transmit an electrical signal converted from the received audio data into the loudspeaker 1561, and the loudspeaker 1561 converts the electrical signal into a voiceprint signal to output; and on the other hand, the microphone 1562 converts the collected voiceprint signal into an electrical signal, the audio circuit 1560 receives the electrical signal and converts the electrical signal into audio data, the audio data is output to the processor 1580 to process and is transmitted to, for example, another mobile phone through the RF circuit, or the audio data is output to the memory 1520 for further processing.

Wi-Fi belongs to a short-distance wireless transmission technology. The mobile phone may help users receive and send E-mail, browse websites, access to streaming media, or the like, and provides wireless broadband Internet access for the users. FIG. 4 shows a Wi-Fi module 1570, but it may be understood that the Wi-Fi module 1570 does not belong to a necessary constitution of the mobile phone and may be omitted according to requirements completely without changing the essence of the present disclosure.

The processor 1580 is a control center of the mobile phone, may connect various parts of the entire mobile phone by various interfaces and circuits, and may perform various functions of the mobile phone and process data by operating or performing soft programs and/or modules stored in the memory 1520 and calling the data stored in the memory 1520, thereby entirely monitoring the mobile phone. Optionally, the processor 1580 may include at least one processing units; and preferably, the processor 1580 may integrate an application processor and a modem processor. The application processor is mainly used for processing an operating system, a user interface, and an application program, or the like; and the modem processor is mainly used for processing wireless communication. It should be understood that the modem processor may also not be integrated into the processor 1580.

The mobile phone may further include a power source 1590 (such as a battery) for supplying power for various parts, preferably, the power supply may be connected to the processor 1580 by a power management system, such that functions of managing charging and discharging, managing power consumption, or the like can be implemented by the power management system.

Although not shown, the mobile phone may further include a camera, a Bluetooth module, or the like, and is not repeatedly described.

With the solutions according to the embodiment of the present disclosure, the accurate time point when the bass drum is knocked in the music can be automatically acquired, thereby providing information for analyzing rhythm and emotional flow of the whole piece of music and achieving high efficiency; and the corresponding special effects can be more fitted with the music itself by adding specific audio and video effects on the beat points of the bass drum, thereby achieving better product effect and being presented on products in real time.

It should be understood that although the various steps in the flowchart of the drawings are sequentially displayed as indicated by the arrows, these steps are not necessarily performed in the order indicated by the arrows. Except as explicitly stated herein, the execution of these steps is not strictly limited, and may be performed in other sequences. Moreover, at least some of the steps in the flowchart of the drawings may include a plurality of sub-steps or stages, which are not necessarily performed at the same time, but may be executed at different time. The execution order thereof is also not necessarily performed sequentially, but may be performed alternately or alternately with at least a portion of other steps or sub-steps or stages of other steps.

The above description is only some embodiments of the present disclosure, and it should be noted that those skilled in the art may also make several improvements and modifications without departing from the principles of the present disclosure which should be considered as the scope of protection of the present disclosure.

What is claimed is:

1. A method for detecting audio signal beat points of a bass drum, comprising:

acquiring a plurality of intrinsic mode functions based on an input audio signal to be detected;

calculating instantaneous signals corresponding to the plurality of intrinsic mode functions, wherein the instantaneous signals comprises instantaneous strength signals and instantaneous frequency signals;

acquiring characteristic signals of the bass drum based on the instantaneous signals corresponding to the plurality of intrinsic mode functions;

performing peak detection on the characteristic signals to acquire a plurality of peak points; and acquiring beat points of the bass drum based on the plurality of peak points; and wherein after acquiring the characteristic signals of the bass drum and before performing the peak detection on the characteristic signals to acquire the plurality of peak points, the method further comprises:

acquiring all valley points of the characteristic signals;

calculating a full width at half maximum of a signal valley formed by each of the valley points and two peak points most proximal to the valley point;

acquiring a signal valley with the full width at half maximum less than a preset first threshold, and eliminating the acquired signal valley using the characteristic signals adjacent to the acquired signal valley by interpolation; and updating the preset first threshold, and returning the step of acquiring the signal valley with the full width at half maximum less than the preset first threshold until acquiring a smooth characteristic signal.

2. The method for detecting the audio signal beat points of the bass drum according to claim 1, wherein performing the peak detection on the characteristic signals to acquire the plurality of peak points comprises:

performing the peak detection on the characteristic signals to acquire maximum points; and selecting a maximum point that satisfies a preset condition from the maximum points, and identifying the selected maximum point as the peak point.

3. The method for detecting the audio signal beat points of the bass drum according to claim 2, wherein after identifying the selected maximum point as the peak point, the method further comprises:

calculating a full width at half maximum of a signal peak formed by each peak point and adjacent points of each peak point after Gaussian fitting; and retaining a corresponding peak point in the case where the full width at half maximum is less than a preset threshold; otherwise, eliminating the corresponding peak point.

4. The method for detecting the audio signal beat points of the bass drum according to claim 1, wherein acquiring the characteristic signals of the bass drum based on the instantaneous signals corresponding to the plurality of intrinsic mode functions comprises:

multiplying the squared instantaneous strength signal of a target function by the corresponding instantaneous frequency signal of the target function to acquire an equivalent instantaneous frequency of the target function, wherein the target function is any one of the plurality of the intrinsic mode functions; and summing the equivalent instantaneous frequencies of the plurality of the intrinsic mode functions to acquire the characteristic signals of the bass drum.

5. The method for detecting the audio signal beat points of the bass drum according to claim 1, wherein after performing the peak detection on the characteristic signals to acquire the plurality of peak point and before acquiring the beat points of the bass drum based on the plurality of peak points, the method further comprises:

finding a maximum value within an adjacent area of a position indicated by each of the peak points in the characteristic signals, and taking the point with the found maximum value as an aligned peak point.

6. The method for detecting the audio signal beat points of the bass drum according to claim 1, wherein after performing the peak detection on the characteristic signals to acquire the plurality of peak point and before acquiring the beat points of the bass drum based on the plurality of peak points, the method further comprises:

eliminating the plurality of peak points by a specified processing mode.

7. The method for detecting the audio signal beat points of the bass drum according to claim 1, wherein after acquiring the beat points of the bass drum based on the plurality of peak points, the method further comprises:

adding preset audio and video effects at the positions where the beat points of the bass drum are located.

8. A non-transitory computer-readable storage medium storing at least one computer program, wherein the at least one computer program, when being executed by a processor, enables the processor to perform the method for detecting the audio signal beat points of the bass drum as defined in claim 1.

9. A terminal, comprising:

at least one processors;

a memory for storing at least one programs, wherein when the at least one programs are executed by the at least one processors, the at least one processors are enabled perform the method for detecting the audio signal beat points of the bass drum as defined claim 1.

10. The method for detecting the audio signal beat points of the bass drum according to claim 2, wherein the preset condition comprises: any one point of the characteristic signals between two consecutive maximum points is not the maximum point, and a minimum value of the characteristic signals between the two consecutive maximum points satisfies that a ratio of the minimum to the two consecutive maximum points is less than a set ratio threshold.

11. The method for detecting the audio signal beat points of the bass drum according to claim 2, wherein the preset condition comprises: any one point of the characteristic signals between two consecutive maximum points is not the maximum point, and a minimum value of the characteristic signals between the two consecutive maximum points satisfies that a difference value between the minimum value and the two consecutive maximum points is greater than a set difference threshold.

12. The method for detecting the audio signal beat points of the bass drum according to claim 6, wherein the specified processing mode comprises:

counting, within the adjacent area of the position indicated by each of the peak points in the characteristic signals, the number of the characteristic signals, of which values exceed a preset ratio of values of the characteristic signals corresponding to the corresponding peak points, in the adjacent area, and eliminating the corresponding peak points in the case where the number exceeds a preset threshold.

13. The method for detecting the audio signal beat points of the bass drum according to claim 6, wherein the specified processing mode comprises:

eliminating, in the case where an interval between the two consecutive peak points is less than a preset interval threshold, the peak points corresponding to the characteristic signals with small values.

14. The method for detecting the audio signal beat points of the bass drum according to claim 6, wherein the specified processing mode comprises:

calculating, in the case where the values of the characteristic signals corresponding to one peak point are less than the values of the characteristic signals corresponding to other peak points, a prominent degree of the peak point compared with the characteristic signals in the adjacent area, and eliminating the peak point in the case where the prominent degree is less than a preset threshold.

15. The method for detecting the audio signal beat points of the bass drum according to claim 2, wherein acquiring the characteristic signals of the bass drum based on the instantaneous strength signals and the instantaneous frequency signals corresponding to the plurality of intrinsic mode functions comprises:

multiplying the squared instantaneous strength signal of a target function by the corresponding instantaneous frequency signal of the target function to acquire an equivalent instantaneous frequency of the target function; wherein the target function is any one of the plurality of the intrinsic mode functions; and summing the equivalent instantaneous frequencies of the plurality of the intrinsic mode functions to acquire the characteristic signals of the bass drum.

16. The method for detecting the audio signal beat points of the bass drum according to claim 3, wherein acquiring the characteristic signals of the bass drum based on the instantaneous strength signals and the instantaneous frequency signals corresponding to the plurality of intrinsic mode functions comprises:

multiplying the squared instantaneous strength signal of a target function by the corresponding instantaneous frequency signal of the target function to acquire an equivalent instantaneous frequency of the target function; wherein the target function is any one of the plurality of the intrinsic mode functions; and summing the equivalent instantaneous frequencies of the plurality of the intrinsic mode functions to acquire the characteristic signals of the bass drum.

* * * * *